United States Patent [19]

Wasserlein, Jr.

[11] Patent Number: 4,533,201

[45] Date of Patent: Aug. 6, 1985

[54] BRIDGE TAP

[75] Inventor: Henry G. Wasserlein, Jr., Seminole, Fla.

[73] Assignee: AMP Incorporated, Harrisburg, Pa.

[21] Appl. No.: 596,972

[22] Filed: Apr. 5, 1984

[51] Int. Cl.[3] ..... H01R 4/24

[52] U.S. Cl. ..... 339/99 R; 339/97 P

[58] Field of Search ..... 339/97 R, 97 P, 98, 339/99 R, 107

[56] References Cited

U.S. PATENT DOCUMENTS

| | | | |
|---|---|---|---|
| 3,189,863 | 6/1965 | Leach | 339/99 |
| 3,576,518 | 4/1971 | Bazille, Jr. et al. | 339/98 |
| 3,985,416 | 10/1976 | Dola et al. | 339/98 |
| 4,023,883 | 5/1977 | Raposa et al. | 339/98 |
| 4,101,189 | 7/1978 | Moser et al. | 339/99 R |
| 4,258,974 | 3/1981 | Kuo et al. | 339/97 R |
| 4,279,460 | 7/1981 | Forberg | 339/97 P |
| 4,284,316 | 8/1981 | Debaigt | 339/107 |
| 4,364,622 | 12/1982 | Huntley | 339/97 R |
| 4,391,484 | 7/1983 | Foederer | 339/97 P |

FOREIGN PATENT DOCUMENTS

| | | | |
|---|---|---|---|
| 2078450 | 1/1982 | United Kingdom | 339/97 R |

*Primary Examiner*—John McQuade

*Attorney, Agent, or Firm*—Russell J. Egan

[57] ABSTRACT

A bridge tap connector is formed by a pair of top and bottom covers. The bottom cover has a plurality of terminals secured therein, each terminal having a pair of slotted plate configurations extending normal to each other and to the plane of the bottom cover. Like pluralities of first and second pairs of conductor gripping means are spaced on opposite sides of each terminal, each pair aligned to secure a conductor overlying a respective slotted plate. Conductors of a tap cable are dressed in the bottom cover and secured by the first pairs of gripping means. Conductors of a continuous cable are dressed in the bottom cover and secured by the second pairs of gripping means overlying and normal to the tap cable conductors. Stuffer means integral with the top cover drive the conductors into terminating engagement in the respective slotted plates when the top cover is applied to the bottom cover.

14 Claims, 8 Drawing Figures

BRIDGE TAP

The present invention relates to a connector for joining a multiconductor tap cable to a multiconductor continuous run cable.

In the past there have been a number of attempts to provide cable tapping devices or devices for interconnecting continuous runs of multiconductor cable at a cross-over point. Each of these known devices has attained a certain degree of success but none of them have met all the outstanding needs. For example, U.S. Pat. No. 4,364,622 shows a connector having terminals with a chevron profile. While this is functional, it is inefficient because of the spacing requirements thereby making it unsuitable for high density situations. U.S. Pat. Nos. 3,189,863 and 4,258,974 show other crossover interconnect devices which would be useful only with flat cable.

In the telecommunications industry there is frequently the need for attaching a tap cable to a primary continuous run cable. Frequently these taps are needed at places where it is extremely inconvenient to work so that ease of assembly and effecting the tap become of primary importance. The present invention is designed with convenience in mind and is so arranged that a helper or assistant could apply the tap cable to the bottom cover and hand it to the installer at a remote location, such as at the top of a ladder in a plenum opening, who would then apply the top cover to the prepared continuous run cable and effect the termination by closure of the covers.

The subject bridge tap connector is formed by a pair of mating top and bottom covers which define therebetween a cavity with first and second cable entry ports extending in opposite directions therefrom and a tap cable port extending essentially normally to the axis of the other two ports. The bottom cover includes a terminal mounting portion including a plurality of profiled terminal recesses and like pluralities of first and second pairs of conductor gripping members, with the members of each pair spaced on opposite sides of a respective terminal recess and with the pairs of members aligned so that their axes are generally normal to one another. Each terminal is formed from a single piece of sheet stock material and has a base of essentially rectangular configuration with a first slotted flange extending from a first side, a second slotted flange extending from a second side normal to said first side, and a third flange extending from a third side normal to one of said first and second sides with the third flange having a dimple thereon located to engage in a respective terminal recess of the bottom cover to hold the terminal in place. The bottom cover is also provided with mounting means and means to assemble the top cover thereon. The top cover has a plurality of inwardly-directed stuffer assemblies each profiled to engage a respective conductor and stuff it into an appropriate slotted flange of a respective terminal in the bottom cover The present invention will be described by way of example with reference to the accompanying drawings in which:

Figure 8:
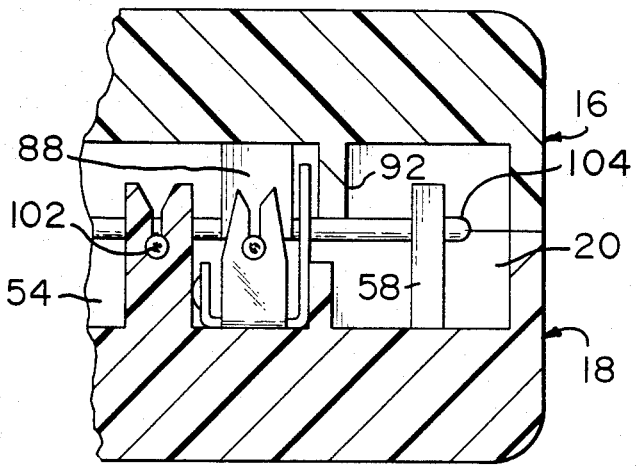
FIG. 8 is a transverse section through an end portion of the present invention in a fully assembled and terminated condition.

The subject bridge tap connector 10 (FIG. 1) has a generally rectangular profile and is intended for use in joining a multiconductor tap cable 12 to a continuous run multiconductor cable 14. The connector 10 is formed by a top cover 16 and a bottom cover 18 which together define therebetween a cavity 20 (FIG. 8).

Figure 2:
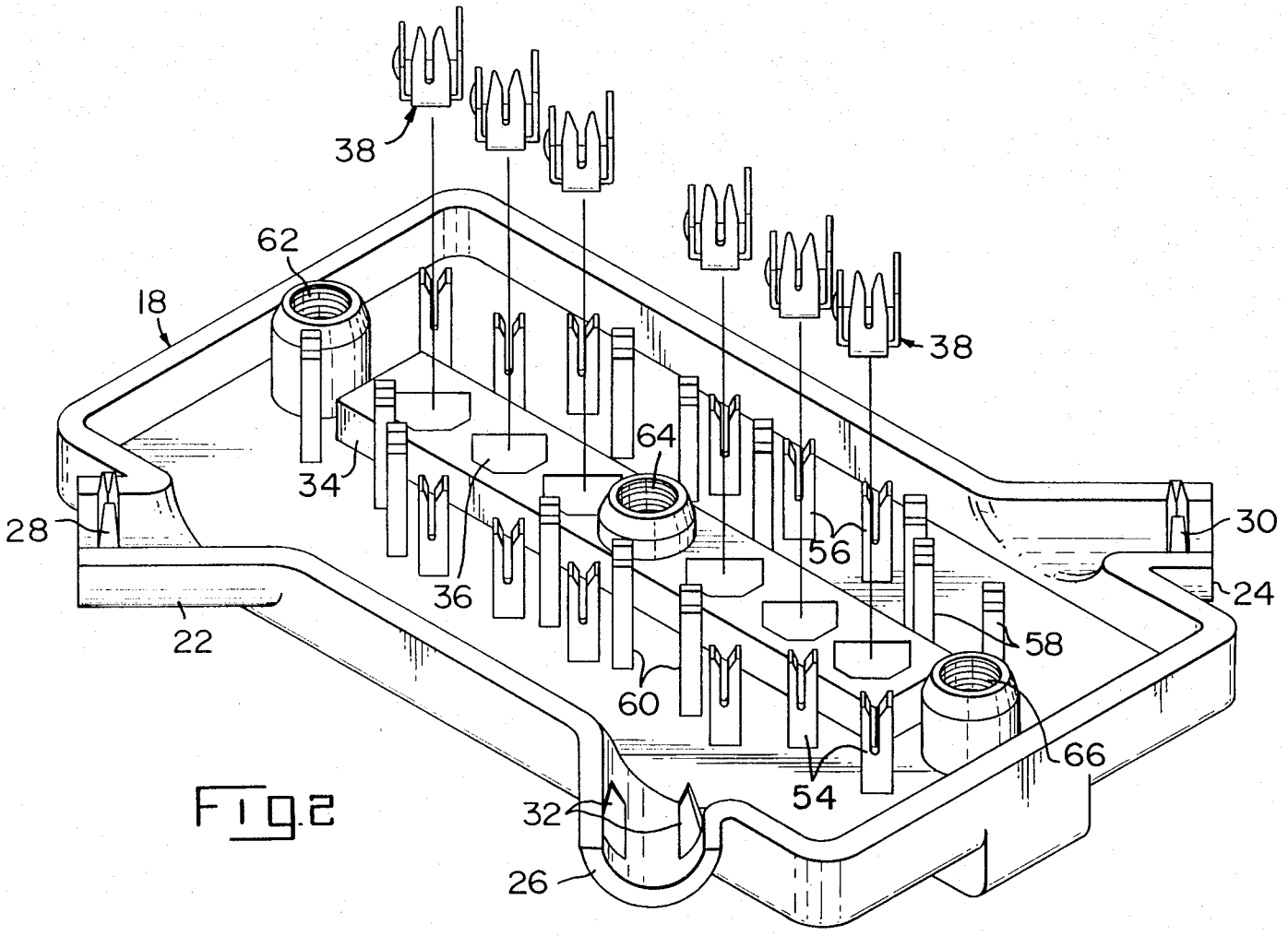
FIG. 2 is a perspective view of the bottom cover with the terminals exploded therefrom.
Figure 3:
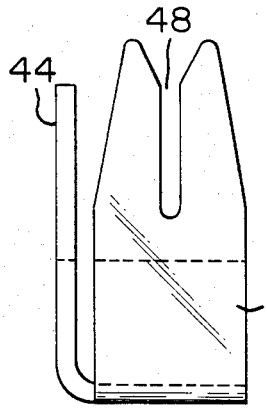
FIG. 3 is a first side elevation of a terminal according to the present invention.
Figure 4:
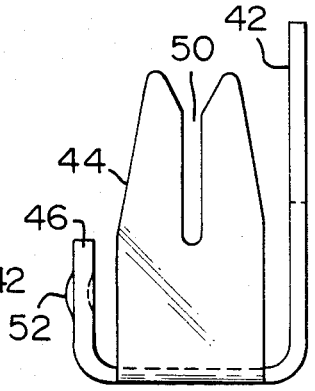
FIG. 4 is a second side elevation of the subject terminal taken 90° from the elevation of FIG. 3.
Figure 5:
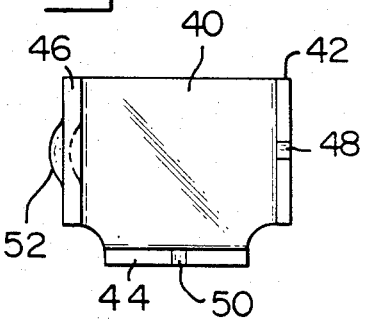
FIG. 5 is a top plan of the subject terminal.

The bottom cover 18 (FIG. 2) has a pair of oppositely directed, semicylindrical continuous cable entry ports 22, 24 and a similarly-shaped tap cable entry port 26. Each of the entry ports is provided with a pair of integral, profiled cable gripping arms 28, 30, 32. Substantially centrally of the bottom cover 18 is an integral elongated terminal mounting stage 34 containing a plurality of profiled terminal cavities 36. A terminal 38 (FIG. 2) is received in each cavity. Each terminal 38 is stamped and formed from stock metal material and has a base portion 40 (FIGS. 3 to 5) with an integral first slotted flange 42, a second integral slotted flange 44, and a third integral flange 46, each flange extending normally from adjacent sides of the base 40. The base 40 is profiled to accommodate reception of the terminal 38 in a respective cavity 36. The first and second flanges are profiled to define insulation-piercing conductor-engaging slot 48, 50 while the third flange is provided with an outwardly directed detent bump 52. The first and second flanges 42, 44 are of sufficient length to extend out of the cavity 36, as best seen in FIG. 8. The bottom cover 18 is further provided with a plurality of pairs of integral tap cable conductor gripping members 54, 56 and continuous run cable conductor gripping members 58, 60, each aligned with and spaced from opposite sides of the cavities 36. The bottom cover is further provided with integral, profiled mounting and alignment members 62, 64, 66 which, preferably, are aligned along the axis of the mounting stage 34. Each member 62, 64, 66 has a threaded bore or receptor (not shown) secured therein.

Figure 7:
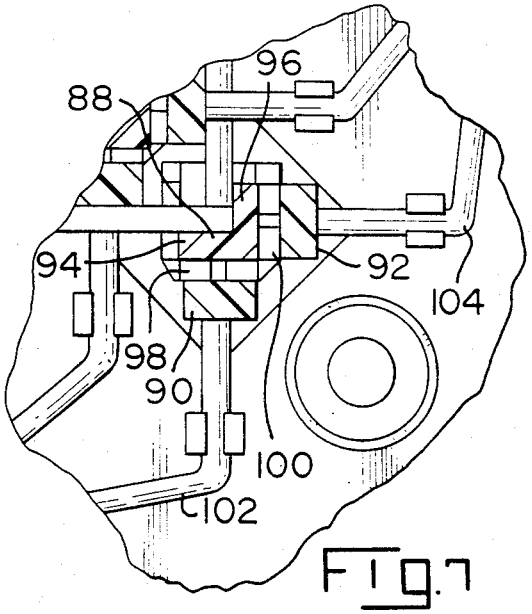
FIG. 7 is a top plan view of the bottom cover with portions of the top cover shown in section to illustrate the connector in a terminated condition.

The top cover 16 (FIG. 1) has a pair of oppositely directed, semicylindrical continuous cable entry ports 68, 70 and a similarly shaped tap cable entry port 72, each aligned with a respective port 22, 24, 26 of the bottom cover 18. Integral mounting and alignment members 74, 76 are at opposite ends of cover 16 aligned with respective members 62, 66 of the bottom cover 18. There is also a central aperture 78 aligned with member 64. Fastening means 80, 82, 84 are respectively mounted in the members 74, 76 and aperture 78 and preferably are threaded to engage in the receptors of the bottom cover. The top cover 16 also has a like plurality of conductor stuffer assemblies 86, each aligned with a respective terminal 38. Each conductor stuffer assembly 86 is formed by first, second and third blocks 88, 90, 92 (FIG. 7). The first block 88 has arms 94, 96 forming an L-shape in section. The second block 90 is rectangular and spaced from arm 94 to define a passage 98 therebetween. The third block 92 is also rectangular and is spaced from arm 96 to define a passage 100 therebetween.

Figure 1:
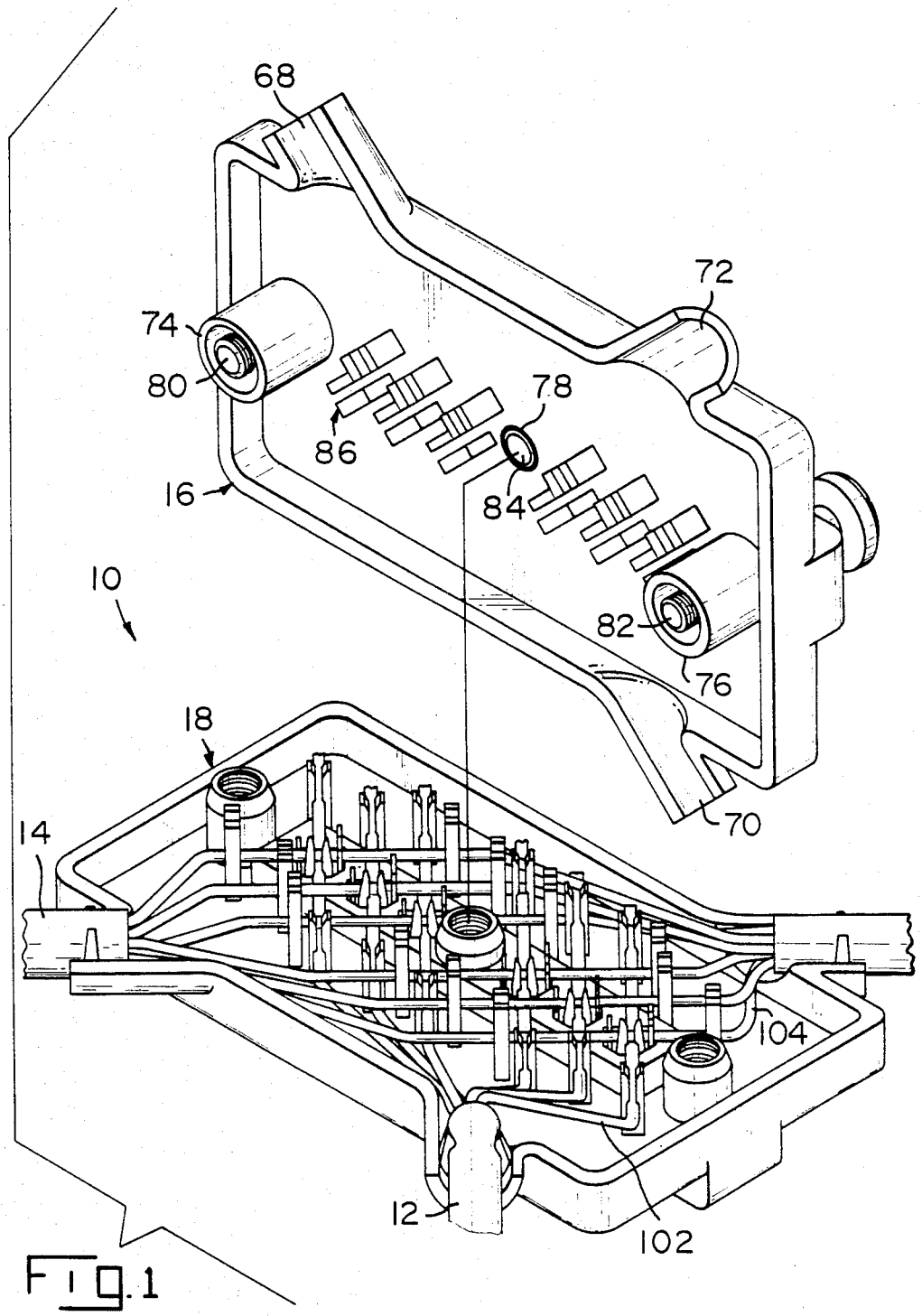
FIG. 1 is a perspective view of the subject invention with the top cover exploded therefrom and with the tap and continuous cables terminated in place.
Figure 6:
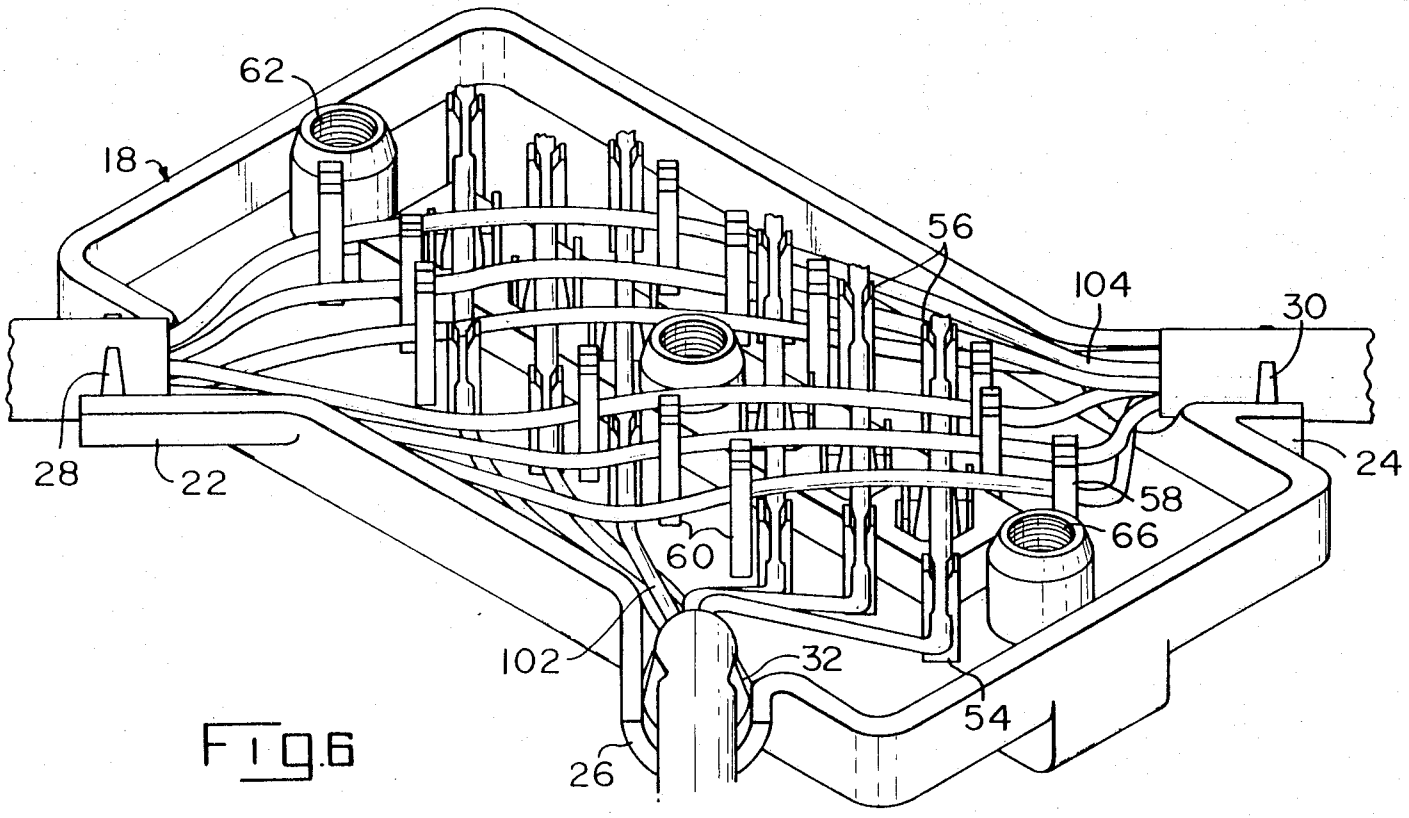
FIG. 6 is a perspective view of the bottom cover with the tap and continuous run cables in place but not yet terminated.

The subject invention would first have terminals 38 loaded into the respective cavities 36. The conductors 102 of the tap cable 12 are dressed and secured by gripping members 54, 56 to overlie the respective slots 50 in the second flanges 44 of the terminals 38. The tap cable 12 extends from port 26 where it is held by gripping arms 32. At this point in time the conductors 102 merely span the terminals 38 since termination has not yet been effected. The conductors 102 and tap cable 12 are held in the bottom cover 18 securely enough that the tap cable 12 can be handled in normal fashion, for example to pass it to a plenum opening as previously suggested. The installer would then dress the conductors 104 of the continuous run cable 14 in the respective gripping members 58, 60 to overlie the respective slots 48 in the first flanges 42 of the terminals 38. The subject invention will now be as shown in FIG. 6 with both sets of conductors 102, 104 properly positioned with respect to the terminating slots of the proper terminal 38. The upper cover 16 is then applied to the lower cover 18 and secured thereto by the fastening means 80, 82, 84. This causes the stuffer assemblies 86 to drive the conductors 102, 104 into their respective slots. The passages 98, 100 receive the flanges 44, 42 respectively. The end surfaces of block 90 and arm 94 drive a tap cable conductor 102 into slot 50 of flange 44 while the end surfaces of block 92 and arm 96 drive a continuous cable conductor 104 into slot 48 of flange 42. The conductors 102, 104 will now be positioned in the terminals as shown in FIGS. 1, 7 and 8.

It should be noted that when the conductors 102, 104 are initially dressed in the connector, they are bowed between the respective gripping members 54, 56 and 58, 60 to pass over the terminals 38. When the conductors 102, 104 are stuffed down into the slots 50, 48, there is more length of conductor than is necessary. Thus there will be a limited amount of slack in the conductors between the gripping members assuring no tension on the conductor at the terminal slot and some strain relief.

It is within the purview of the present invention to provide alternate means for securing the top and bottom covers together. Also, one or both covers can be provided with mounting means.

I claim:

1. A bridge tap connector for joining a multiconductor tap cable to a multiconductor continuous run cable, said bridge tap connector comprising:

a pair of mating bottom and top covers of rigid insulative material, said covers together defining a cavity therebetween, a plurality of terminals fixed in said bottom cover, each terminal having first and second flanges extending normal to each other and to the plane of said bottom cover into said cavity, each said first and second flange having an insulation-piercing, conductor-engaging slotted profile, a plurality of pairs of conductor gripping members, the members of each pair being integral with said bottom cover and spaced on opposite sides of a respective first or second flange aligned with the slotted profile thereof, a plurality of conductor stuffer members integral with said top cover and extending integrally therefrom into said cavity, each said conductor stuffer member being aligned with a respective terminal and adapted to drive conductors of said tap and continuous run cables into said slotted profiles, and means to secure said covers together.

2. A bridge tap connector according to claim 1 wherein said covers together define oppositely directed, aligned continuous run cable ports and a tap cable port substantially normal to the axis of said continuous run cable ports.

3. A bridge tap connector according to claim 2 further comprising cable gripping means integral with one of said covers.

4. A bridge tap connector according to claim 3 wherein said cable gripping means are located in each said port.

5. A bridge tap connector according to claim 1 wherein said bottom cover has a substantially centrally located terminal mounting stage having a plurality of profiled terminal receiving cavities therein.

6. A bridge tap connector according to claim 1 further comprising orienting means on said bottom and top covers whereby correct alignment of said stuffer members with respect to said terminal flanges is assured.

7. A bridge tap connector according to claim 1 wherein said means to secure said covers together comprises at least one threaded receptor in said bottom cover and a like number of threaded driving members in said top cover whereby sufficient driving force can be generated to assure seating of said conductors in the respective slotted flanges of the terminals.

8. A bridge tap connector according to claim 1 wherein each said terminal is stamped and formed from stock metal and has a base portion with said first and second flanges connected to adjacent sides of said base portion by respective bights, said flanges extending normal to each other and said base portion.

9. A bridge tap connector according to claim 8 wherein each said terminal further comprises a third flange connected to a third side of said base portion by a bight, said third flange having an outwardly directed detent bump whereby each said terminal is securely mounted in said bottom cover.

10. A bridge tap connector according to claim 9 wherein said first flange is longer than said second flange and the slotted profiles of said first and second flanges are identical whereby said conductors of said continuous run cable overlie said conductors of said tap cable.

11. A bridge tap connector according to claim 1 wherein said conductor stuffer members comprise an L-shaped first block and second and third substantially rectangular blocks each spaced parallel to a respective arm of said first block to define first and second terminal flange receiving passageways therebetween, whereby said conductor stuffer members will both drive a respective conductor into the slotted profile of a flange while supporting said flange.

12. A bridge tap connector according to claim 1 wherein said terminals are aligned with said first flanges normal to the path of the conductors of said continuous run cable and said second flanges normal to the path of the conductors of said tap cable.

13. A bridge tap connector according to claim 1 wherein said conductor gripping members provide strain relief for the respective conductors.

14. A bridge tap connector comprising a pair of mating covers which define therebetween a cavity with first and second cable entry ports extending in opposite directions therefrom and a tap cable port extending essentially normally from the axis of the other two ports, said bottom cover having a terminal mounting portion with a plurality of profiled terminal recesses and like pluralities of first and second pairs of conductor gripping means with the members of each pair spaced on opposite sides of a terminal recess with the pairs aligned so that their axes are essentially normal to one another, a plurality of terminals such formed from a single piece of sheet stock material and having a base of essentially rectangular configuration with a first slotted flange extending from a first side, a second slotted flange extending from a second side normal to said first side, and a third flange extending from a third side normal to one of said first and second sides with the third flange having a dimple thereon which dimple engages in the terminal recess of the bottom cover to hold the terminal in place, a plurality of inwardly-directed stuffer members integral with said top cover, each profiled to engage a respective conductor and drive it into a slotted flange of a respective terminal in said bottom cover, and means to secure said covers together.

* * * * *